US011742627B2

(12) United States Patent
Lee

(10) Patent No.: US 11,742,627 B2
(45) Date of Patent: Aug. 29, 2023

(54) MULTI-ADAPTER COMPRISING CONNECTOR CONNECTED TO EXTERNALLY EXTENDABLE CABLE

(71) Applicant: Samsung Electronics Co., Ltd., Gyeonggi-do (KR)

(72) Inventor: Sunmi Lee, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 73 days.

(21) Appl. No.: 17/299,843

(22) PCT Filed: Dec. 4, 2019

(86) PCT No.: PCT/KR2019/017012

§ 371 (c)(1),
(2) Date: Jun. 4, 2021

(87) PCT Pub. No.: WO2020/116929

PCT Pub. Date: Jun. 11, 2020

(65) Prior Publication Data

US 2022/0029367 A1 Jan. 27, 2022

(30) Foreign Application Priority Data

Dec. 4, 2018 (KR) ..... 10-2018-0154170

(51) Int. Cl.
*H01R 31/06* (2006.01)
*H01R 13/72* (2006.01)
*H01R 24/60* (2011.01)

(52) U.S. Cl.
CPC ..... *H01R 31/065* (2013.01); *H01R 13/72* (2013.01); *H01R 24/60* (2013.01)

(58) Field of Classification Search
CPC ..... H01R 31/065; H01R 13/72; H01R 24/60
(Continued)

(56) References Cited

U.S. PATENT DOCUMENTS 3,821,496 A * 6/1974 De Troy ..... H02G 11/02 439/4
5,660,568 A * 8/1997 Moshayedi ..... H01R 31/005 439/945

(Continued)

FOREIGN PATENT DOCUMENTS

CN 201237751 Y 5/2009
CN 201681618 U 12/2010

(Continued)

OTHER PUBLICATIONS

European Search Report dated Jan. 4, 2022.
Chinese Office Action dated Oct. 25, 2022.
Chinese Office Action dated Jun. 28, 2023.

*Primary Examiner* — Alexander Gilman
(74) *Attorney, Agent, or Firm* — Cha & Reiter, LLC

(57) ABSTRACT

Disclosed is a multi-adapter. A multi-adapter according to various embodiments comprises: a housing including an interior space; a first connector which can be stored in the interior space and can be withdrawn through an outlet formed in the housing; a lever which is detachable from a part of the first connector, disposed to be reciprocable in the interior space, and at least partially exposed through an opening formed in a side surface of the housing; at least one second connector which is connectable to an external electronic device or an external power source, and is exposed through the side surface of the housing; and a cable which extends from the first connector and electrically connects the first connector and the at least one second connector, wherein the lever moves in one direction such that the first connector can be withdrawn from the housing.

14 Claims, 11 Drawing Sheets

(58) Field of Classification Search
USPC ..... 439/131
See application file for complete search history.

(56) References Cited

U.S. PATENT DOCUMENTS

| | | | | |
|---|---|---|---|---|
| 5,690,198 | A * | 11/1997 | Lohr | H02G 11/02 439/501 |
| 5,913,487 | A * | 6/1999 | Leatherman | H02G 11/02 242/378.4 |
| 5,989,042 | A * | 11/1999 | Johnson | H01R 13/639 439/131 |
| 6,077,108 | A * | 6/2000 | Lorscheider | H04Q 1/066 439/4 |
| 6,327,507 | B1 * | 12/2001 | Buchan | H02G 11/02 191/12.4 |
| 6,433,274 | B1 * | 8/2002 | Doss | H01R 13/72 174/59 |
| 6,471,542 | B1 * | 10/2002 | Comer | H01R 13/72 439/531 |
| 6,588,444 | B2 * | 7/2003 | Paplow | B65H 75/4471 137/15.01 |
| 8,151,820 | B1 * | 4/2012 | Larkin | H02G 11/02 242/399 |
| 8,643,601 | B2 | 2/2014 | Chang et al. | |
| 9,184,546 | B2 * | 11/2015 | Fleisig | H01R 25/003 |
| 9,209,572 | B1 * | 12/2015 | Dunwoody | H01R 13/6583 |
| 9,373,912 | B1 * | 6/2016 | Juds | H01R 13/635 |
| 9,472,913 | B1 * | 10/2016 | Mizrahi | H01R 27/02 |
| 9,912,154 | B2 * | 3/2018 | Fleisig | H01R 13/665 |
| 10,056,725 | B1 * | 8/2018 | Surratt | H01R 31/06 |
| 10,130,276 | B2 * | 11/2018 | Lane | A61B 5/303 |
| 10,978,841 | B2 * | 4/2021 | Liao | H01R 13/60 |
| 2006/0286861 | A1 * | 12/2006 | Avevor | H01R 13/60 439/501 |
| 2007/0119999 | A1 * | 5/2007 | Liao | H02G 11/02 242/378.4 |
| 2012/0094528 | A1 * | 4/2012 | Vroom | H01R 13/73 439/540.1 |
| 2012/0307981 | A1 * | 12/2012 | Larkin | G01R 1/0416 379/27.01 |
| 2014/0057495 | A1 | 2/2014 | Liao et al. | |
| 2015/0357772 | A1 * | 12/2015 | Bruchmann | H02B 1/21 439/122 |
| 2016/0209885 | A1 * | 7/2016 | Ellis | H04M 1/0258 |
| 2017/0353591 | A1 * | 12/2017 | Abramovich | H01R 24/68 |
| 2019/0204882 | A1 * | 7/2019 | Tseng | G06F 1/28 |
| 2019/0341711 | A1 * | 11/2019 | Justin | H02G 11/02 |
| 2019/0341714 | A1 * | 11/2019 | Du | H04L 69/08 |
| 2021/0234302 | A1 * | 7/2021 | Zhang | H01R 24/60 |
| 2021/0376546 | A1 * | 12/2021 | Barnett | H01R 27/00 |
| 2022/0029367 | A1 * | 1/2022 | Lee | H01R 24/60 |

FOREIGN PATENT DOCUMENTS

| | | | |
|---|---|---|---|
| CN | 102074835 | A | 5/2011 |
| CN | 203250875 | U | 10/2013 |
| CN | 205960746 | U | 2/2017 |
| CN | 207664862 | U | 7/2018 |
| KR | 20-0189657 | Y1 | 7/2000 |
| KR | 20-0360122 | Y1 | 8/2004 |
| KR | 10-2005-0051439 | A | 6/2005 |
| KR | 10-0690756 | B1 | 3/2007 |
| KR | 10-2008-0004697 | A | 1/2008 |
| KR | 20-2011-0003692 | U | 4/2011 |
| KR | 10-1417739 | B1 | 8/2014 |
| KR | 10-2015-0049783 | A | 5/2015 |
| KR | 10-2016-0026414 | A | 3/2016 |
| WO | 2014/073224 | A1 | 5/2014 |

* cited by examiner

MULTI-ADAPTER COMPRISING CONNECTOR CONNECTED TO EXTERNALLY EXTENDABLE CABLE

CROSS REFERENCE TO RELATED APPLICATIONS

This application is a National Phase Entry of PCT International Application No. PCT/KR2019/017012, which was filed on Dec. 4, 2019, and claims a priority to Korean Patent Application No. 10-2018-0154170, which was filed on Dec. 4, 2018, the contents of which are incorporated herein by reference.

TECHNICAL FIELD

Various embodiments relate to a multi-adapter including a connector connected to an externally extendable cable.

BACKGROUND ART

A multi-adapter or a dongle may include various interfaces for connecting various input/output devices or storage media to a portable electronic device (for example, a laptop computer, a tablet PC, or a smartphone). An electronic device may perform mirroring or display sharing, for example, with an external display device by using the multi-adapter or dongle. By using a device including various interfaces, a portable electronic device may connect a storage medium (for example, a USB), thereby expanding the storage space, or may connect to a network at various places. Electronic devices may overcome the limitation of space by using the multi-adapter or dongle including various interfaces.

DISCLOSURE OF INVENTION

Technical Problem

A multi-adapter may include a connector for connecting with an external electronic device, and the connector may be connected to a cable. The cable may have a predetermined length so as to facilitate connection with an external electronic device. The connector and the cable, if exposed to the outside, may be damaged or broken by an unwanted external force, and this may degrade the durability of the device.

There is a need for a scheme for storing the connector and the cable without exposure to the outside and exposing the connector only when used for connection with an electronic device.

Solution to Problem

A multi-adapter according to various embodiments may include: a housing including an internal space; a first connector configured to be able to be accommodated in the internal space and to be able to be pulled out through an outlet formed at the housing; a lever configured to be attachable and detachable to and from a portion of the first connector, disposed in the internal space to be able to reciprocate, and configured to be at least partially exposed through an opening formed on a side surface of the housing; at least one second connector configured to be able to be connected with an external electronic device or an external power source and configured to be exposed through the side surface of the housing; and a cable extending from the first connector and configured to electrically connect the first connector and the at least one second connector, wherein the lever is moved in one direction, whereby the first connector is pulled out of the housing.

Advantageous Effects of Invention

A multi-adapter according to various embodiments may accommodate a connector coupled to an electronic device and a cable extended to the connector inside a housing including various interfaces, thereby reducing the risk that the connector and the cable will be damaged, and improving user convenience.

The user may adjust the length of the cable according to the environment in which the multi-adapter is used, and the cable is conveniently accommodated, thereby improving portability.

Advantageous effects obtainable from the disclosure are not limited to the above-mentioned advantageous effects, and other advantageous effects not mentioned herein will be clearly understood from the following description by those skilled in the art to which the disclosure pertains.

BEST MODE FOR CARRYING OUT THE INVENTION

Figure 1A:
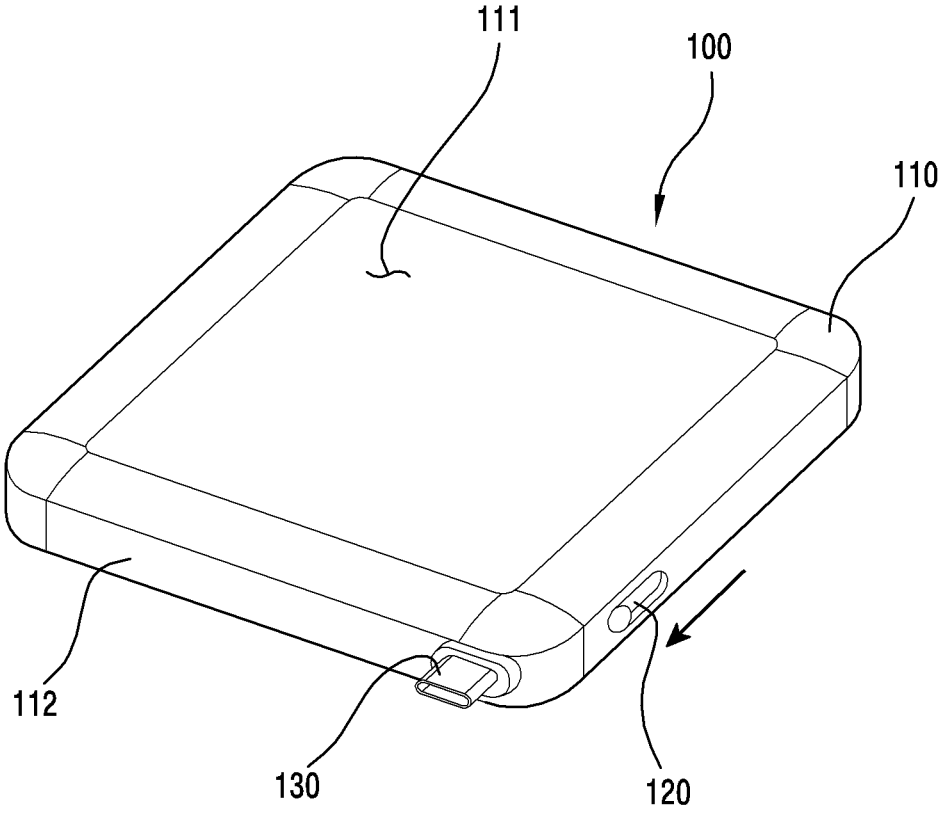
FIG. 1A is a perspective view of a multi-adapter including various interfaces according to an embodiment.
Figure 1B:
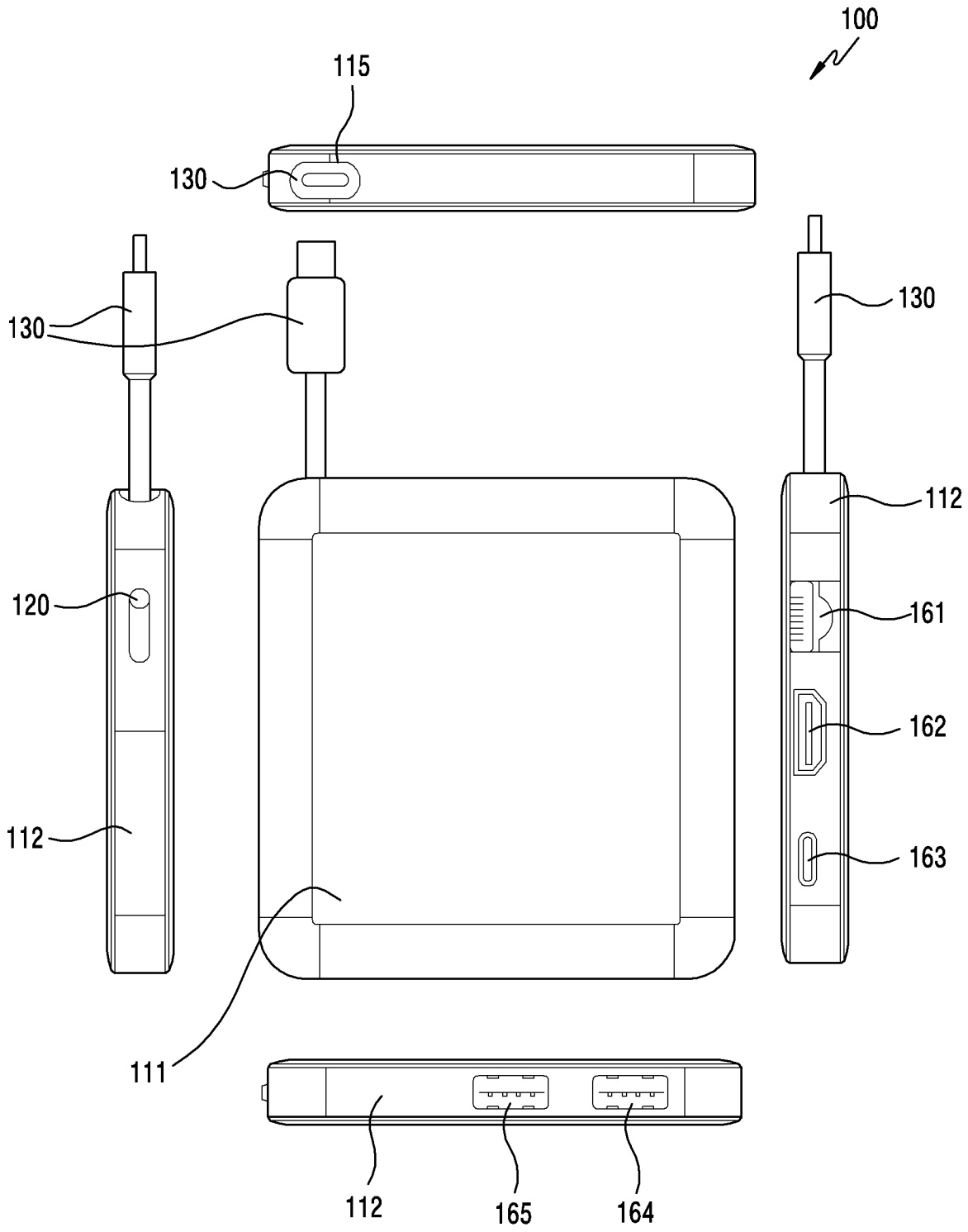
FIG. 1B is a front view and a side view of the multi-adapter including various interfaces according to an embodiment.

FIG. 1A is a perspective view of a multi-adapter including various interfaces according to an embodiment and FIG. 1B is a front view and a side view of the multi-adapter including various interfaces according to an embodiment.

Referring to FIGS. 1A and 1B, a multi-adapter 100 may include a housing 110, a first connector 130, and a plurality of second connectors 161, 162, 163, 164, and 165. The housing 110 may include a first surface (or a front surface) 111, a side surface 112, and a second surface (or a rear surface) (the rear surface 190 of FIG. 3) facing the first surface 111. The first surface 111 and the second surface 190 may be spaced apart from each other, and the side surface 112 may be formed along the first surface 111 and the second surface. The first surface 111, the second surface 190, and the side surface 112 may form an internal space of the housing 110. The first surface 111, the second surface 190, and the side surface 112 may be formed independently from one another, and the first surface 111, the second surface 190, and the side surface 112 may be combined and integrally formed with one another. The housing 110 may be substantially made of an opaque material. The housing 110 may be made of ceramic, a polymer, metal or a combination of at least two of these materials.

According to an embodiment, the housing 110 may be formed in various shapes. For example, the first surface 111 and the second surface 190 of the housing 110 may be made of a polygonal shape, a circular shape, or an elliptical shape. The first surface 111 and the second surface may be formed in shapes corresponding to each other. The side surface 112 of the housing 110 may be formed to correspond to the shapes of the first surface and the second surface. The housing 110 may include a plurality of openings that exposes the first connector 130 and a plurality of terminals 161, 162, 163, 164, and 165 forming the second connector. The first connector 130 and the plurality of terminals 161, 162, 163, 164, and 165 forming the second connector may be exposed through the side surface 112 of the housing 110.

According to various embodiments, the first connector 130 may include at least one of a USB Type-C terminal or a micro USB 5-pin terminal. The first connector 130 may be exposed through an outlet 115 formed on the side surface 112 of the housing 110. The first connector 130 may protrude out of the housing 110 through the outlet 115 and may be accommodated in the housing 110 through the outlet 115. The first connector 130 may be pulled out of the housing 110 and connected with an external electronic device. The external electronic device may be connected with another external electronic device, a storage medium, or a network that is coupled to the plurality of terminals 161, 162, 163, 164, and 165. The first connector 130 may be exposed to the outside through the outlet 115 of the housing 110 by a lever 120 exposed on the side surface 112 of the housing 110. The first connector 130 may be connected with a flexible cable and the cable may electrically connect the plurality of terminals 161, 162, 163, 164, and 165 of the second connector and the first connector 130 to each other.

According to an embodiment, the plurality of terminals 161, 162, 163, 164, and 165 of the second connector may be applied to various kinds of interfaces. The plurality of terminals 161, 162, 163, 164, and 165 may include at least one of a network connection terminal 161, a video connection terminal 162, a power supply terminal 163, or storage medium connection terminals 164 and 165.

According to various embodiments, the plurality of terminals 161, 162, 163, 164, and 165 of the second connector may include at least one of a USB slot, a High Definition Multimedia Interface (HDMI) slot, a USB Type-C slot, or a network slot.

According to various embodiments, the network connection terminal 161 may be an RJ45 terminal (or socket). The network connection terminal 161 may be connected with an external network and may be a wire communication module (e.g., a Local Area Network (LAN) communication module or a power line communication module). An external electronic device that is connected with the multi-adapter 100 can communicate with another external electronic device through the network connection terminal 161 (a wide area network such as the internet or a computer network).

According to various embodiments, the video connection terminal 162 may include an HDMI interface. An external electronic device connected with the first connector 130 may be physically connected with another external electronic device through the video connection terminal 162.

According to various embodiments, the power supply terminal 163 may be a connector for transmitting and receiving power and/or data to and from an external electronic device. The power supply terminal 163 can supply power to the multi-adapter 100 or can supply power to an external electronic device connected with the first connector 130. According to an embodiment, the power supply terminal 163 may be connected with a power management module included in the multi-adapter 100 and can supply or receive power to or from at least one of the first connector 130 or the connection terminals 161, 162, 163, 164, and 165 of the second connector.

According to various embodiments, the storage medium connection terminals 164 and 165 may include a Universal Serial Bus (USB). The storage medium connection terminals 164 and 165 may include a USB connector. The storage medium connection terminals 164 and 165 may connect USBs having different transmission speeds, respectively. For example, the storage medium connection terminals 164 and 165 may be one of a USB 2.0 or USB 3.0 port.

Figure 2:
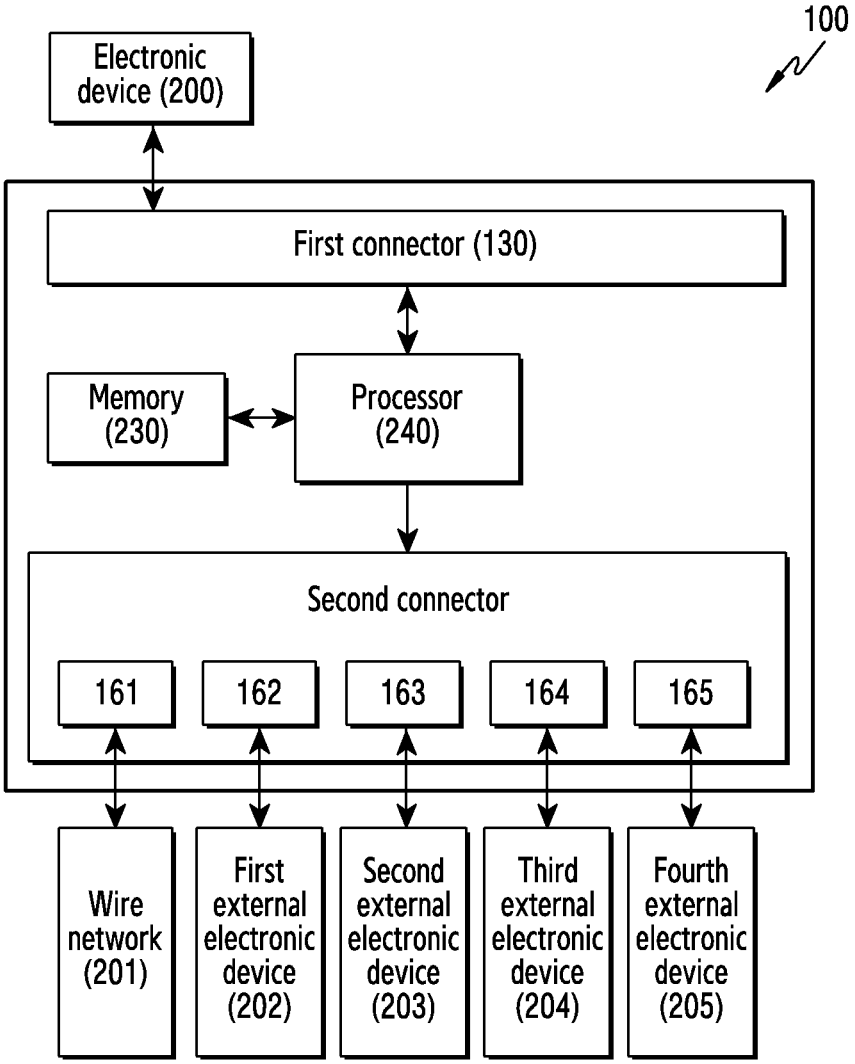
FIG. 2 is a block diagram of a multi-adapter including various interfaces according to an embodiment.

FIG. 2 is a block diagram of a multi-adapter including various interfaces according to an embodiment.

Referring to FIG. 2, a multi-adapter 100 may include a first connector 130, second connectors 161, 162, 163, 164, and 165, and a processor 240 electrically connected with the first connector 130 and the second connectors 161, 162, 163, 164, and 165.

According to various embodiments, the first connector 130 may be connected with an electronic device 200 and the connection terminals 161, 162, 163, 164, and 165 of the second connector may be connected with a wire network 201, a first external electronic device 202, a second external electronic device 203, a third external electronic device 204, and a fourth external electronic device 205, respectively. According to various embodiments, the second connectors 161, 162, 163, 164, and 165, the processor 240, and a memory 230 may be mounted on a printed circuit board. The first connector 130 may be connected to the printed circuit board through a cable or a conductor.

According to various embodiments, the processor 240 can store commands or data, which are received from an electronic device connected with the first connector 130 or the external electronic devices 202, 203, 204, and 205 connected through the second connectors 161, 162, 163, 164, and 165, in the memory 230 and can process the commands or data stored in the memory 230. According to various embodiments, the processor 240 can transmit the commands or data, which are received from an electronic device connected with the first connector 130 or the external electronic devices 202, 203, 204, and 205 connected through the second connectors 161, 162, 163, 164, and 165, or the commands or data stored in the memory 230. For example, the processor 240 and receive can process data related to programs that are executed in the electronic device 200 and can transmit the processed data to the external electronic devices 202, 203, 204, and 205 connected to the second connectors 161, 162, 163, 164, and 165. The external electronic devices 202, 203, 204, and 205 can store or process and can output the received data. When a received data is a voice signal, the external electronic devices 202, 203, 204, and 205 can output the voice signal through sound output devices of the external electronic devices 202, 203, 204, and 205. For example, when a received data is an image data, the external electronic devices 202, 203, 204, and 205 can output the voice signal through image output devices of the external electronic devices 202, 203, 204, and 205. When the external electronic devices 202, 203, 204, and 205 are storage media, they can store received data and can transmit the data to another electronic device connected to a network through the wire network 201.

According to various embodiments, the memory 230 can store a device identifier of an electronic device connected to the first connector 130 and the second connectors 161, 162, 163, 164, and 165, or connection information corresponding to the device identifier. The processor 240 is connected with the memory 230, the first connector 130, and the second connectors 161, 162, 163, 164, and 165, thereby being able to connection between electronic devices linked to the first connector 130 and the second connectors 161, 162, 163, 164, and 165. The processor 240 may enable electronic devices to share device information, driver information, etc. of the electronic devices for connection of the electronic devices.

According to various embodiments, the processor 240 may be configured such that when the wire network 201 is connected to one terminal 161 of the second connectors and the electronic device 200 is connected to the first connector 130, the electronic device 200 can communicate with an external network through the wire network 201. At least one or more of the first external electronic device 202, the second external electronic device 203, the third external electronic device 204, or the fourth external electronic device 205 may be connected through the second connectors 161, 162, 163, 164, and 165, and the electronic device 200 may be connected to the first connector 130. When there is a request for connection to the second electronic device 203 of the external electronic devices 202, 203, 204, and 205 from the electronic device 200, the processor 240 may maintain connection with the second electronic device 203. When the request for connection to the second electronic device 203 is a sound signal and an image signal, the processor 240 can output the sound signal and the image signal through the second external electronic device 203.

According to various embodiments, when the fourth external electronic device 205 is an input device (e.g., a keyboard, a touchpad, or a mouse) and when there is a request for connection with the fourth external electronic device 205 that is an input device from the electronic device 200, the processor 240 can maintain connection with the fourth external electronic device 205. When there is input through the fourth external electronic device 205, the processor 240 can transmit an input signal to the electronic device 200.

Figure 3:
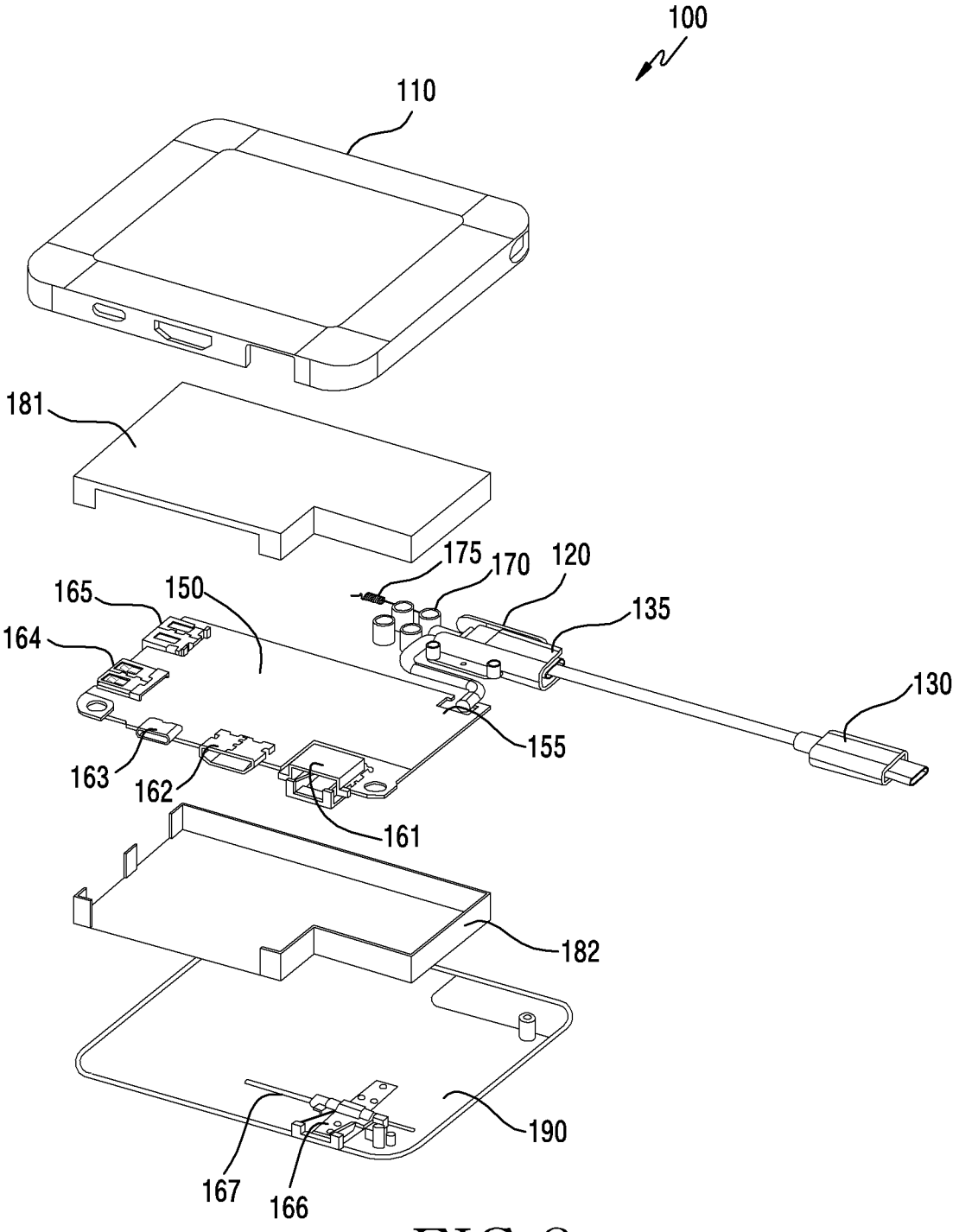
FIG. 3 is an exploded perspective view of a multi-adapter including various interfaces according to an embodiment.
Figure 4:
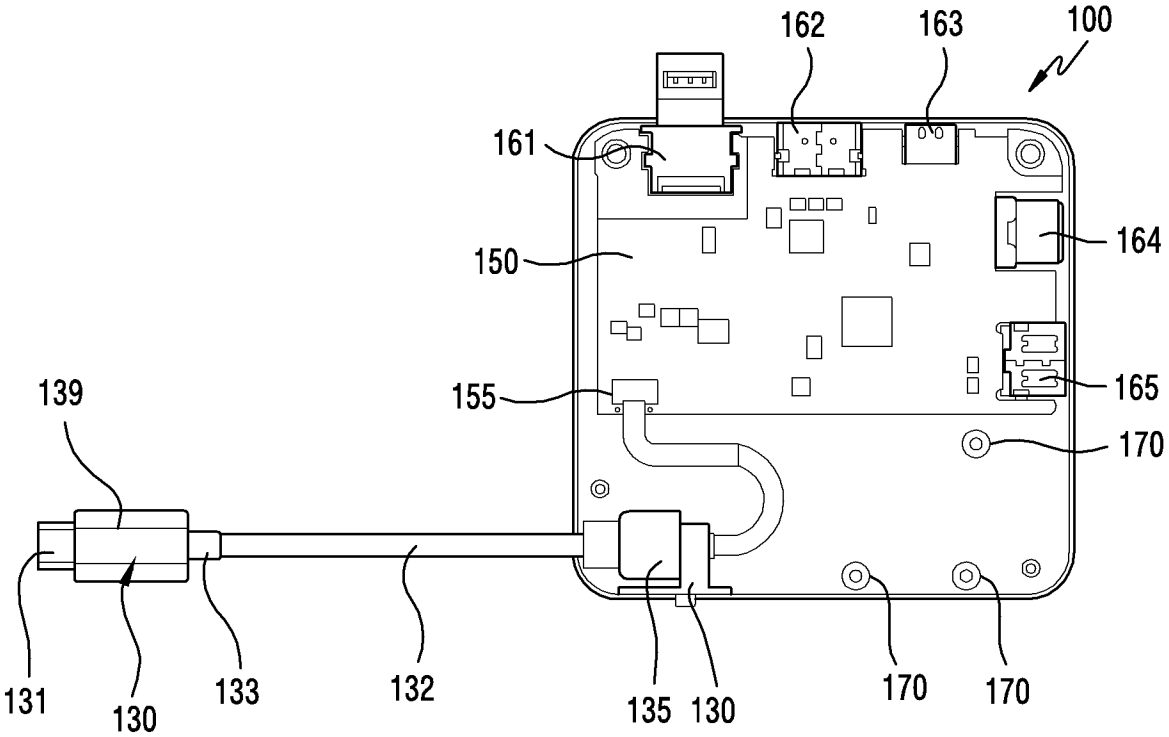
FIG. 4 shows arrangement of a printed circuit board and a cable according to an embodiment.

FIG. 3 is an exploded perspective view of a multi-adapter including various interfaces according to an embodiment. FIG. 4 shows arrangement of a printed circuit board and a cable according to an embodiment.

Referring to FIGS. 3 and 4, a multi-adapter 100 may include a front housing 110, a rear cover 190, internal housings 181 and 182, a first connector 130, second connectors 161, 162, 163, 164, and 165, and a printed circuit board 150.

According to various embodiments, the front housing 110 and the rear housing 190 may form the internal space of the multi-adapter 100. The printed circuit board 150 and the first connector 130 may be disposed in the internal space. The front housing 110 may form the front surface and the side surface of the housing, and the side surface of the front housing 110 may include openings through which the first connector 130 and the second connectors 161, 162, 163, 164, and 165 can be exposed. The openings may be formed in shapes corresponding to the first connector 130 and the second connectors 161, 162, 163, 164, and 165, respectively.

According to various embodiments, a terminal 131 may be formed at an end of the first connector 130 and a cable 132 may extend from the other end of the first connector 130. The cable 132 and a socket 139 of the first connector 130 may be connected through a connecting portion 133. The cable 132 may pass through a socket holder 135 and a portion of a lever 120 and may be connected with the printed circuit board 150 through a connecting portion 155 of the printed circuit board 150. The lever 120 may be exposed to the outside through an opening formed on the side surface of the housing and may straightly reciprocated in the internal space of the housing 110. A portion of the lever 120 may be attached and detached to and from the connecting portion 133 of the first connector 130. When the first connector 130 is accommodated in the housing, the socket 139 of the first connector 130 is disposed and fixed in the socket holder 135 and the connecting portion 133 is fastened to a portion of the lever 120, whereby the lever 120 is moved in the opposite direction to the pulling-out direction of the first connector 130. The socket holder 135 may include a space having a size in which the socket 139 of the first connector 130 can be accommodated, and the lever 120 may include an opening or a ring shape having a size to which the connecting portion 133 can be locked. The socket holder 135 may be fastened to the rear cover 190. The lever 120 may be used as a passage through which the cable 132 is moved when the first connector 130 is pulled out or accommodated.

According to various embodiments, the printed circuit board 150 may be disposed on the rear cover 190 and the rear cover 190 may have a fastener (not shown) for fastening to the printed circuit board 150. The fastener may be protrusion including a threaded groove for thread-fastening. The printed circuit board 150 may include an opening corresponding to the protrusion including the threaded groove. The second connectors 161, 162, 163, 164, and 165 may be mounted on the printed circuit board 150, may be disposed toward the side surface of the housing, and may be exposed through the openings formed on the side surface of the housing 110. The printed circuit board 150 may include a processor (e.g., the processor 240 of FIG. 2), a memory (e.g., the memory 230 of FIG. 2), and a power management module (e.g., a PMIC). The processor, the memory, and the power management module may be electrically connected with the second connectors 161, 162, 163, 164, and 165 and the connecting portion 155 of the first connector 130 through the printed circuit board 150.

According to various embodiments, the internal housings 181 and 182 may be disposed in the area in which the printed circuit board 150 is disposed. The internal housings 181 and 182 may include an upper housing 181 and a lower housing 182. The internal housings 181 and 182 can divide the internal space of the housing 110. The internal housings 181 and 182 can separate the space in which the printed circuit board 150 is disposed and the space in which the cable 132 and the first connector 130 are accommodated. The side surfaces of the internal housings 181 and 182 are partition walls and can prevent the cable 132 accommodated in the housing 110 from coming in contact with the printed circuit board 150.

According to various embodiments, the areas of the internal housings 181 and 182 in which the second connectors 161, 162, 163, 164, and 165 are disposed may be open. The network connection terminal 161 of the second connectors 161, 162, 163, 164, and 165 may be designed to be disposed outside the internal housings 181 and 182. The size of a connection port of the network connection terminal 161 may be changed to connect a network connection connector. A plate spring 166 and a plate spring shaft 167 may be disposed to change the size of the connection port of the network connection terminal 161. The area facing the side surface of the housing 110 from the shaft, in the plate spring 166, may be spaced apart from the rear case 190 in a normal state, and when it is fastened to a network connection connector, it may come in contact with the rear case 190. When the network connection connector is separated from the network connection terminal 161, the plate spring 166 can be returned to the initial position (e.g., the position spaced apart from the rear case) by elasticity.

According to various embodiments, a roller 170 may be disposed in the housing 110 to smoothly move the cable 132 disposed outside the internal housings 181 and 182. The roller 170 may be rotatably disposed in the housing. When the cable 132 is inserted into the housing 110, the cable 130 can be smoothly moved by rotation of the roller 170. The roller 170 may include a center hole and a column corresponding to the center hole may be disposed in the housing 110, so the roller 170 can be rotated. The roller 170 may be disposed at a position where the roller 170 can come in contact with the cable 132 when the cable 132 is accommodated into the housing 110.

According to various embodiments, an end of the lever 120 may be coupled to an elastic member 175 (e.g., a spring or a rubber band). When the lever 120 is moved toward the outlet of the housing 110 to push out the cable 132 and the first connector 130, the first connector 130 can protrude. The elastic member 175 applies a force in a direction in which the lever 120 is pulled. When a force that is applied toward the lever 120 from the outside is removed, the lever 120 is moved away from the outlet, whereby the lever 120 can be returned to the initial position. A portion of the first connector 130 may not be coupled to the lever 120, but be able to move in the lever to prevent the first connector 130 from moving when the lever 120 is returned.

Figure 5:
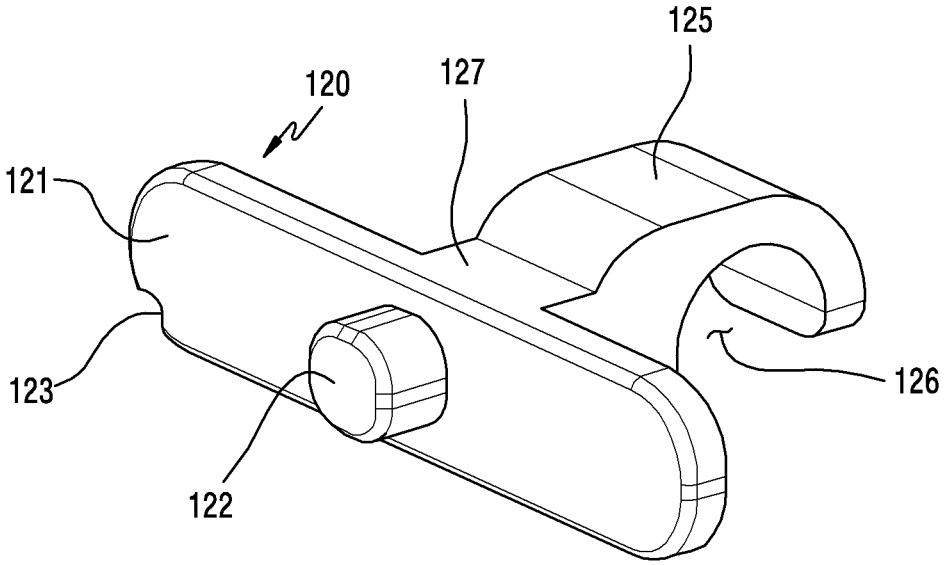
FIG. 5 is a perspective view of a lever according to an embodiment.

FIG. 5 is a perspective view of a lever according to an embodiment.

Referring to FIG. 5, the lever 120 may include a body 121 including a first surface exposed through an opening formed on the side surface of the housing 110, a button 122 protruding from the first surface of the body 121, and a hook-shaped fastening member 125 extending from a second surface opposite to the first surface and can be coupled to a portion of the first connector 130.

According to various embodiments, the body 121 can slide along a guide groove formed in the opening in which the lever 120 is disposed. The button 122 protruding from the first surface of the body 121 and exposed through the opening can be operated by a user. The button 122 transmits a force applied from the outside to the body 121, thereby being able to move the lever 120. A stepped portion 123 may be formed in a groove shape on the edge of the body 121. The stepped portion 123 can restrict movement of the lever 120 in cooperation with a protrusion or a stopper formed in the guide groove of the housing 110.

According to various embodiments, the lever 120 may have an extension 127 extending from the second surface of the body 121. The hook-shaped fastening member 125 may be formed at the end of the extension 127. The fastening member 125 may have a hook shape and may include a passage 126 through which the cable 132 can pass.

According to an embodiment, the fastening member 125 may be a short pipe having a center hole that is used as a passage through which the cable 132 passes. The passage 126 having a hook shape or a pipe shape may be larger in diameter than the cable 132. The fastening member 125 may be the same or slightly larger in diameter as or than the connecting portion 133. The fastening member 125 and the connecting portion 133 may be coupled to each other and may be separated by an external force. The passage of the fastening member 125 can pass the cable 132, but is coupled to the connecting portion 133 and pushes the socket 139 toward the outlet, whereby the connecting portion 133 can be moved toward the outlet formed in the side surface of the housing 110. When the connecting portion 133 is moved toward the outlet, a portion of the socket 139 connected to the connecting portion 133 can be exposed to the outside of the housing. A user can pull out the cable 132 by pulling the exposed socket 139.

According to various embodiments, the diameter of the passage 126 of the fastening member 125 may be smaller than the diameter of the connecting portion 133 of the cable 132. When the diameter of the passage 126 is smaller than the diameter of the connecting portion 133, the fastening member 125 can expose the connecting portion 133 and a portion of the socket 139 fastened to the connecting portion 133 to the outside of the housing by pushing the connecting portion 133.

Figure 6:
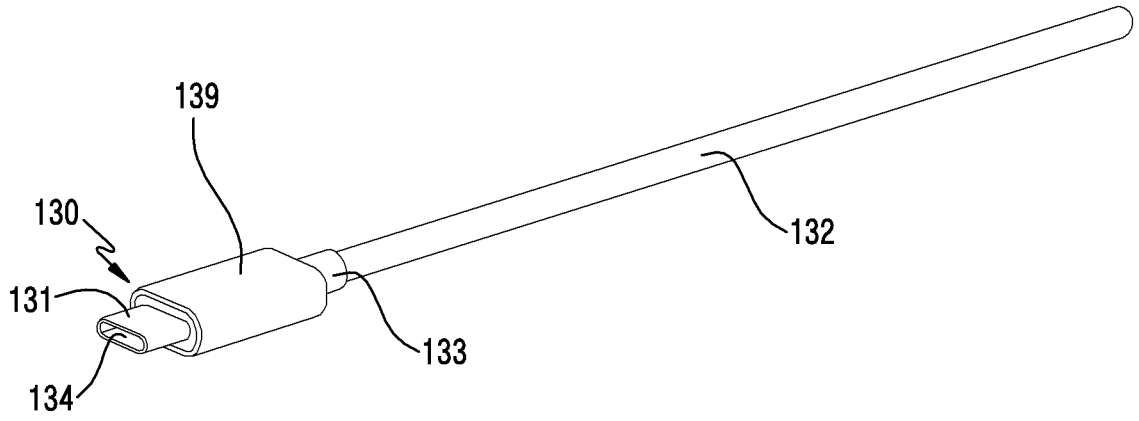
FIG. 6 is a perspective view of a first connector and a cable according to an embodiment.

FIG. 6 is a perspective view of a first connector and a cable according to an embodiment.

Referring to FIG. 6, the first connector 130 may include a terminal 131, a socket 139, a connecting portion 133, and a cable 132. The first connector can be accommodated in the housing 110 when the multi-adapter 100 is not used, and can be pulled out of the housing 110 to be used when the multi-adapter 100 is connected with an external device to be used.

According to various embodiments, the outer portion of the terminal 131 of the first connector 130 may be made of a conductive material and an internal space 134 thereof may be made of a nonconductive material. A metal pin made of a conductive material may be formed on the nonconductive material in the internal space 134. The conductive material formed outside and the metal pin formed inside can supply power or transmit a signal to an electronic device.

According to various embodiments, the socket 139 may be made of a polymer material, may include an element therein for distributing signals and power, and may be connected with a signal line and a power transmission line of the cable 132. The connecting portion 133 is disposed in the joining area between the socket 139 and the cable 132, can prevent cracks that are generated at the joining surface of the cable 132, and can increase durability of the cable 132.

According to various embodiments, the cable 132 may include a signal line and a power transmission line therein. An end of the cable 132 may be connected to the socket 139 coupled to the terminal 132 and the other end thereof may be connected to the printed circuit board 150. The cable 132 can transmit signals, which are transmitted and received through connection of an electronic device and the connector 130, to the printed circuit board 150 through the signal line and can supply power to the electronic device through the power transmission line.

Figure 7:
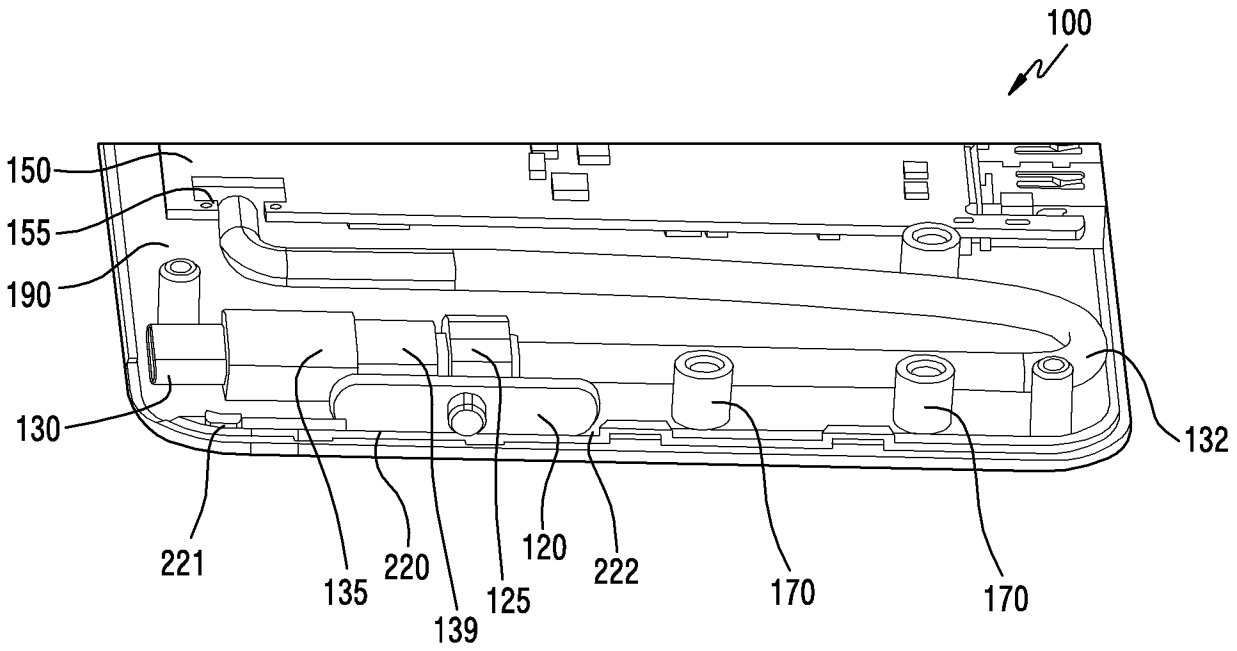
FIG. 7 is a perspective view showing an accommodation state of the first connector and the cable according to an embodiment.

FIG. 7 is a perspective view showing an accommodation state of the first connector and the cable according to an embodiment.

Referring to FIG. 7, a multi-adapter 100 may include a first connector 130, a cable 132, and a lever 120. A socket 139 of the first connector 130 may be accommodated in a socket holder 135. The socket holder 135 may include a through-hole corresponding to the shape of the socket 139 and movement of the socket 139 can be guided through the through-hole. When the first connector 130 is accommodated in the housing 110, the socket 139 can be inserted and fixed in the through-hole of the socket holder 135. When the first connector 130 is exposed to the outside of the housing 110 to be used, the socket 139 can be separated from the socket holder 135 and exposed to the outside of the housing 110. When the first connector 130 is accommodated in the housing 110, the socket holder 135 can fix the position of the socket 139 of the first connector 130 and can prevent the first connector 130 from moving in the housing 110.

According to an embodiment, the cable 132 may come in contact with a roller 170 disposed in the housing 110. The roller 170 is disposed on the rear cover 190 and can rotate about an axis perpendicular to the rear cover 190, whereby the cable 132 can be smoothly moved.

According to an embodiment, the lever 120 may be exposed through the side surface of the housing 11. A guide groove 220 that guides movement of the lever 120 may be formed on the side surface of the housing 110. The lever 120 can reciprocate along the guide groove 220. When the lever 120 is moved outward from the housing, the socket 139 can be pushed by a connecting portion coupled to a fastening member 125 of the lever 120. When at least a portion of the socket 139 is exposed to the outside, a user can pull out the socket 139 by applying a force to the socket 139. When the multi-adapter stops being used and is carried, the cable 132 and the first connector 130 can be accommodated in the housing. When the first connector 130 is accommodated into the housing 110, the lever 120 can be moved outward away from the housing by the socket 139.

According to an embodiment, the lever 120 may include a stepped portion (e.g., the stepped portion 123 of FIG. 5). An end of the guide groove 220 may include a first stopper 221 corresponding to the shape of the stepped portion 123. The lever 120 can move up to the area where the first stopper 221 is positioned, and the first connector 130 and a portion of the socket 139 can be exposed at the joint between the first stopper 221 and the stepped portion 123.

According to an embodiment, the other end of the guide groove 220 may include a second stopper 222. The stopper 222 can define the limit of the lever 120 moving away from the outlet. When the first connector 130 and the socket 139 are pushed into the outlet by an external force, the lever 120 can be moved away from the outlet by the stepped portion formed by the socket 139 and the connecting portion 133. The lever 120 can be stopped by the second stopper 222 when it is moved away from the outlet.

According to various embodiments, the cable 132 may be connected with a connection area 155 of the printed circuit board 150. The signal line and the power transmission line included in the cable 132 may be connected to a signal line and a power transmission line of the printed circuit board 150. The cable 132 and the connection area 155 may be combined by a method that can transmit electricity (e.g., soldering or surface mounting).

Figure 8A:
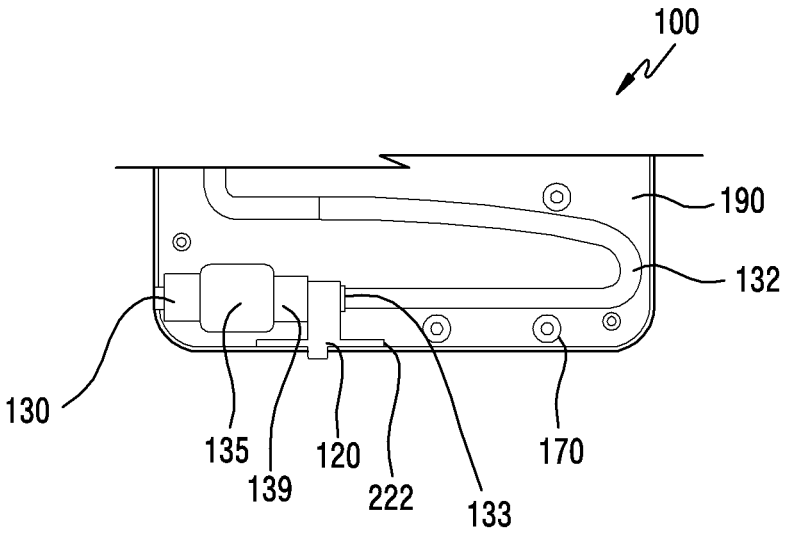
FIG. 8A shows the state in which the first connector and the cable are accommodated in a housing according to an embodiment.
Figure 8B:
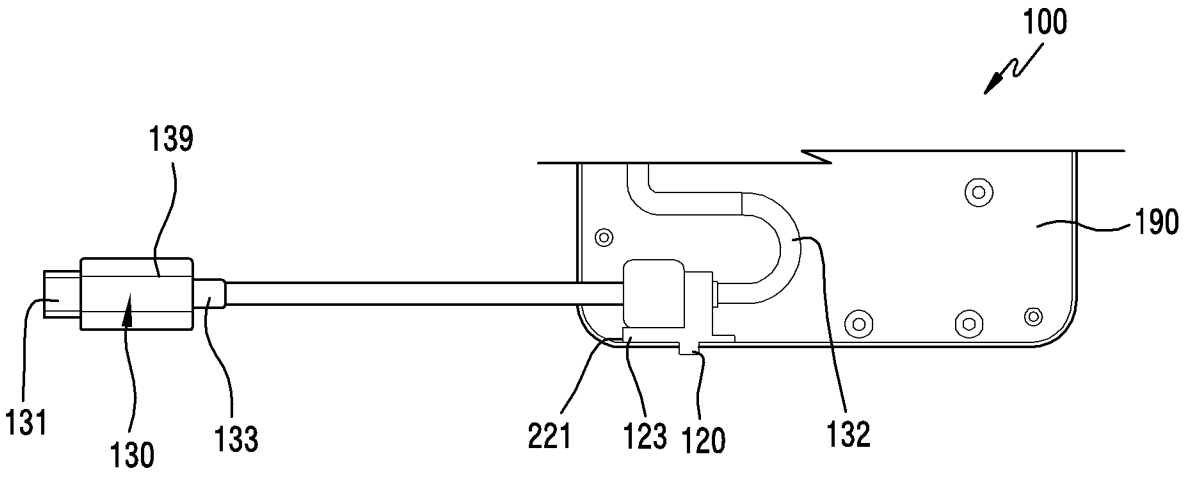
FIG. 8B shows the state in which the first connector and the cable are taken out of a housing according to an embodiment.

FIG. 8A shows the state in which the first connector and the cable are accommodated in a housing according to an embodiment and FIG. 8B shows the state in which the first connector and the cable are taken out of a housing according to an embodiment.

Referring to FIG. 8A, the first connector 130 is accommodated in the housing 110 and may not be exposed to the outside of the housing 110. The cable 132 is accommodated in the housing. The connecting portion 133 formed at an end of the cable 132 may have been inserted in a fastening member (e.g., the fastening member 125) of the lever 120. The fastening member 125 and the socket 139 may be disposed in contact with each other.

According to various embodiments, the socket holder 135 can accommodate the socket 139 and fix the position of the first connector 130, and can prevent the first connector 130 from moving in the housing.

Referring to FIG. 8B, the first connector 130 and the cable 132 can be pulled out of the housing 110. The first connector 130 may be fastened to an electronic device (e.g., the electronic device 200 of FIG. 2). The lever 120 can be moved toward the outlet of the housing and can be moved to the area where the first stopper 221 is disposed by the first stopper 221 stopping the stepped portion 123. When the lever is moved to the first stopper 221, a portion of the first connector 130 can be exposed to the outside, and the first connector 130 and the cable 132 can be pulled outside by an external force.

According to various embodiments, the cable 132 can pass through the spaces formed in the socket holder 135 and the fastening member (e.g., the fastening member 125 of FIG. 5) of the lever 120.

FIGS. 9A to 9D are views showing an operation of pulling out or accommodating the first connector and the cable in the multi-adapter including various interfaces according to an embodiment.

Figure 9:
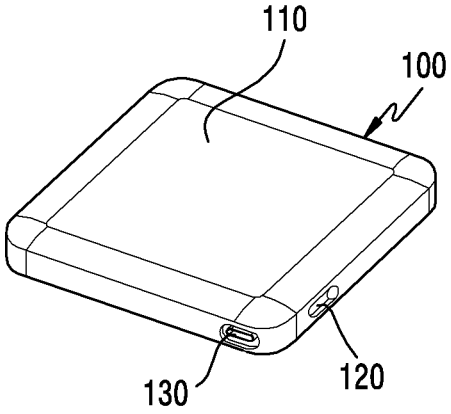
FIGS. 9A to 9D are views showing an operation of pulling out or accommodating the first connector and the cable into the multi-adapter including various interfaces according to an embodiment.
Figure 9:
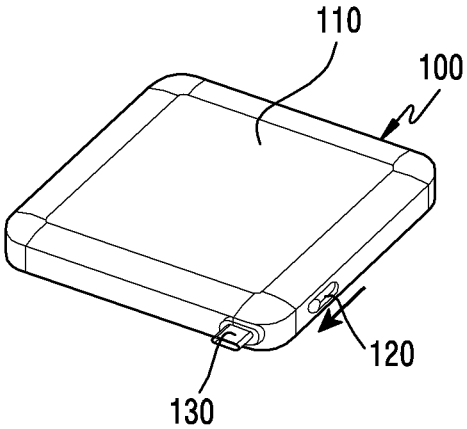
Figure 9:
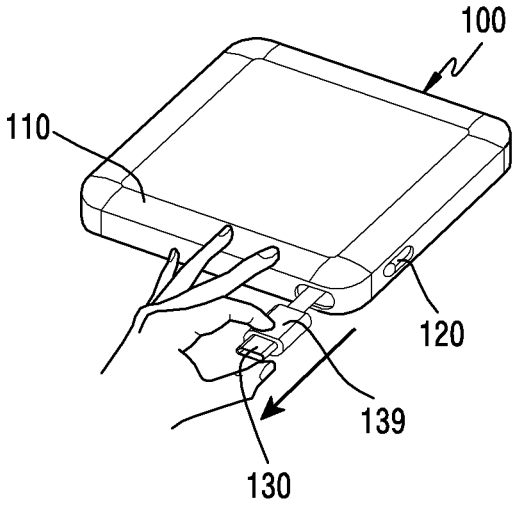
Figure 9:
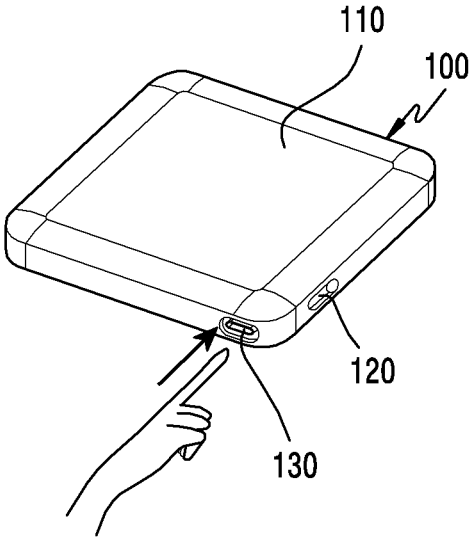

Referring to FIGS. 9A to 9D, the first connector 130 can be accommodated in the housing 110, as in the state shown in FIG. 9A. The multi-adapter may not be used yet or may be being carried.

As in the state shown in FIG. 9B, the lever 120 can be moved in the direction of an arrow by an external force. When the lever 120 is moved in the direction of an arrow, a portion of the first connector 130 can be exposed to the outside of the housing 110. FIG. 9B may show the operation of exposing the first connector 130 to connect an electronic device to the first connector 130.

As in the state shown in FIG. 9C, the first connector 130 can be pulled out of the housing 110 by an external force. A user can expose the first connector 130 by holding and pulled out the socket 139. The first connector 130 can be exposed and connected with an electronic device (e.g., the electronic device of FIG. 2), and the connected electronic device can exchange signals with various electronic devices connected to second connectors (e.g., the second connectors 161, 162, 163, 164, and 165 of FIG. 1B) of the multi-adapter.

As in the state shown in FIG. 9D, the first connector 130 can be moved into the housing 110 by an external force. When the first connector 130 is moved into the housing, the lever 120 can be pushed by the socket 139 of the first connector 130 and can be moved away from the outlet. The state shown in FIG. 9D may be a state in which the multi-adapter stops being used and is stored or carried.

When the multi-adapter is stored with the cable exposed, the cable may be damaged or may be twisted, which may cause inconvenience for a user.

According to various embodiments, a specific space is provided in the housing 110 of the multi-adapter 100, so a cable to be connected to the first connector 130 can be accommodated therein. When the first connector 130 is pulled out to use the multi-adapter 100, a portion of the first connector 130 can be exposed by pushing the lever 120. It is possible to pull out the cable 132 by a necessary length by pulling out the exposed first connector 130, so it is possible to increase convenience for a user and secure ease for storage.

A multi-adapter according to various embodiments described above (e.g., the multi-adapter 100 of FIG. 1A) includes: a housing (e.g., the housing 110 of FIG. 1A) including an internal space; a first connector (e.g., the first connector 130 of FIG. 1A) being able to be accommodated in the internal space and being able to be pulled out through an outlet formed at the housing; a lever (e.g., the lever 120 of FIG. 1A) being attachable and detachable to and from a portion of the first connector, disposed in the internal space to be able to reciprocate, and at least partially exposed through an opening formed on a side surface of the housing; at least one second connector (e.g., the second connectors 161, 162, 163, 164, and 165 of FIG. 1B) being able to be connected with an external electronic device or an external power source and exposed through the side surface of the housing; and a cable (e.g., the cable 132 of FIG. 4) extending from the first connector and electrically connecting the first connector and the at least one second connector, wherein the lever is moved in one direction, whereby the first connector can be pulled out of the housing.

According to various embodiments, the housing may include a guide groove (e.g., the guide groove 220 of FIG. 7) formed at the opening and configured to guide sliding of the lever.

According to various embodiments, the lever may include a body (e.g., the body 121 of FIG. 5) including a first surface exposed through the opening, a button (e.g., the button 122 of FIG. 5) protruding from the first surface of the body, and a hook-shaped fastening member (e.g., the fastening member 125 of FIG. 5) extending from a second surface opposite to the first surface and being able to be coupled to a portion of the first connector.

According to various embodiments, the fastening member can guide movement of the cable when it is separated from the first connector.

According to various embodiments, the body of the lever may include a stepped portion (e.g., the stepped portion 123 of FIG. 5) on the edge thereof, and the guide groove of the housing may include a stopper (e.g., the stopper 221 of FIG. 7) having a shape corresponding to the stepped portion.

According to various embodiments, the first connector may include a connecting portion (e.g., the connecting portion 133 of FIG. 4) having a diameter larger than the diameter of the cable in an area where the first connector is connected with the cable, and the connecting portion can be attached and detached to and from the fastening member.

According to various embodiments, when the lever is moved in one direction, the fastening member can expose the first connector out of the housing by pushing the first connector.

According to various embodiments, the multi-adapter may further include a holder (e.g., the socket holder 135 of FIG. 3 or FIG. 4) that fixes the first connector when the first connector is stored in the housing.

According to various embodiments, the multi-adapter may further include a roller that comes in contact with the cable when the cable is accommodated into the housing.

According to various embodiments, the at least one second connector is mounted on a printed circuit board disposed in the housing and can be exposed out of the housing.

According to various embodiments, the printed circuit board is mounted in a portion of the internal space, and the cable and the first connector can be accommodated in the other area of the internal space.

According to various embodiments, an end of the cable can be connected to the printed circuit board.

According to various embodiments, the multi-adapter may include an internal housing surrounding a portion of the internal space.

According to various embodiments, the at least one second connector may include at least one of a USB slot, a High Definition Multimedia Interface (HDMI) slot, a USB Type-C slot, or a network slot.

According to various embodiments, the first connector may include at least one of a USB type-C terminal or a micro USB 5-pin terminal.

Methods disclosed in the claims and/or methods according to various embodiments described in the specification of the disclosure may be implemented by hardware, software, or a combination of hardware and software.

When the methods are implemented by software, a computer-readable storage medium for storing one or more programs (software modules) may be provided. The one or more programs stored in the computer-readable storage medium may be configured for execution by one or more processors within the electronic device. The at least one program may include instructions that cause the electronic device to perform the methods according to various embodiments of the disclosure as defined by the appended claims and/or disclosed herein.

The programs (software modules or software) may be stored in non-volatile memories including a random access memory and a flash memory, a read only memory (ROM), an electrically erasable programmable read only memory (EEPROM), a magnetic disc storage device, a compact disc-ROM (CD-ROM), digital versatile discs (DVDs), or other type optical storage devices, or a magnetic cassette. Alternatively, any combination of some or all of them may form a memory in which the program is stored. Further, a plurality of such memories may be included in the electronic device.

In addition, the programs may be stored in an attachable storage device which may access the electronic device through communication networks such as the Internet, Intranet, Local Area Network (LAN), Wide LAN (WLAN), and Storage Area Network (SAN) or a combination thereof. Such a storage device may access the electronic device via an external port. Further, a separate storage device on the communication network may access a portable electronic device.

In the above-described detailed embodiments of the disclosure, an element included in the disclosure is expressed in the singular or the plural according to presented detailed embodiments. However, the singular form or plural form is selected appropriately to the presented situation for the convenience of description, and the disclosure is not limited by elements expressed in the singular or the plural. Therefore, either an element expressed in the plural may also include a single element or an element expressed in the singular may also include multiple elements.

Although specific embodiments have been described in the detailed description of the disclosure, various modifications and changes may be made thereto without departing from the scope of the disclosure. Therefore, the scope of the disclosure should not be defined as being limited to the embodiments, but should be defined by the appended claims and equivalents thereof.

The invention claimed is:

1. A multi-adapter comprising:

a housing comprising an internal space;

a first connector configured to be able to be accommodated in the internal space and to be able to be pulled out through an outlet formed at the housing;

a lever configured to be attachable and detachable to and from a portion of the first connector, disposed in the internal space to be able to reciprocate, and configured to be at least partially exposed through an opening formed on a side surface of the housing;

at least one second connector configured to be able to be connected with an external electronic device or an external power source and configured to be exposed through the side surface of the housing; and a cable extending from the first connector and configured to electrically connect the first connector and the at least one second connector, and the cable being further configured to be able to electrically connect the external electronic device connected with the first connector to the external electronic device or the external power source connected with the at least one second connector, wherein the lever is configured to be moved in one direction, whereby the first connector is pulled out of the housing, wherein the lever comprises:

a body having a first surface exposed through the opening, a button protruding from the first surface of the body, and a hook-shaped fastening member extending from a second surface opposite to the first surface and being able to be coupled to a portion of the first connector.

2. The multi-adapter of claim 1, wherein the housing comprises a guide groove formed at the opening and configured to guide sliding of the lever.

3. The multi-adapter of claim 1, wherein the hook-shaped fastening member can guide movement of the cable when the hook-shaped fastening member is separated from the first connector.

4. The multi-adapter of claim 1, wherein the body of the lever comprises a stepped portion on an edge thereof, and the guide groove of the housing comprises a stopper having a shape corresponding to the stepped portion.

5. The multi-adapter of claim 1, wherein the first connector comprises a connecting portion having a diameter larger than a diameter of the cable in an area where the first connector is connected with the cable, and the connecting portion can be attached and detached to and from the hook-shaped fastening member.

6. The multi-adapter of claim 1, wherein when the lever is moved in one direction, the hook-shaped fastening member protrudes the first connector out of the housing by pushing the first connector.

7. The multi-adapter of claim 1, further comprising a holder configured to hold the first connector when the first connector is stored in the housing.

8. The multi-adapter of claim 1, further comprising a roller configured to come in contact with the cable when the cable is accommodated into the housing.

9. The multi-adapter of claim 1, wherein the at least one second connector is mounted on a printed circuit board disposed in the housing and is exposed out of the housing.

10. The multi-adapter of claim 9, wherein the printed circuit board is mounted in a portion of the internal space, and the cable and the first connector can be accommodated in the other area of the internal space.

11. The multi-adapter of claim 10, wherein an end of the cable is connected to the printed circuit board.

12. The multi-adapter of claim 10, further comprising an internal housing surrounding a portion of the internal space.

13. The multi-adapter of claim 1, wherein the at least one second connector comprises at least one of a USB slot, a High Definition Multimedia Interface (HDMI) slot, a USB Type-C slot, or a network slot.

14. The multi-adapter of claim 1, wherein the first connector comprises at least one of a USB type-C terminal or a micro USB 5-pin terminal.

* * * * *